United States Patent [19]

Fritz

[11] Patent Number: 4,968,975

[45] Date of Patent: Nov. 6, 1990

[54] SELF-PENETRATING REMOTE SENSING SMOKE DETECTOR

[76] Inventor: Frank V. Fritz, 218 Martin Rd., Rock Falls, Ill. 61071

[21] Appl. No.: 451,621

[22] Filed: Dec. 18, 1989

[51] Int. Cl.[5] ..... G08B 17/10

[52] U.S. Cl. ..... 340/628; 340/693

[58] Field of Search ..... 340/628, 693, 629, 630; 73/863.71, 863.73, 863.81, 864, 864.41, 864.44, 864.45

[56] References Cited

U.S. PATENT DOCUMENTS

| | | | |
|---|---|---|---|
| 4,177,461 | 12/1979 | Brown et al. | 340/693 |
| 4,178,592 | 12/1979 | McKee | 340/693 |
| 4,833,458 | 5/1989 | Bowman | 340/628 |

FOREIGN PATENT DOCUMENTS

| | | | |
|---|---|---|---|
| 2655976 | 6/1978 | Fed. Rep. of Germany | 340/628 |
| 2846310 | 4/1980 | Fed. Rep. of Germany | 340/693 |

*Primary Examiner*—Joseph A. Orsino
*Assistant Examiner*—Jill Jackson
*Attorney, Agent, or Firm*—David C. Brezina

[57] ABSTRACT

A remote sensing smoke detector suitable for use in a building with hollow walls or ceilings defining inaccessable spaces such as attics, suspended ceilings or an attached closet, garage, or storage area having a main alarm and power source unit affixed on the interior surface of the wall or ceiling, with a mast positioning a sensor to provide a signal to the main alarm unit in the presence of combustion products in the space.

4 Claims, 2 Drawing Sheets

FIG. 1
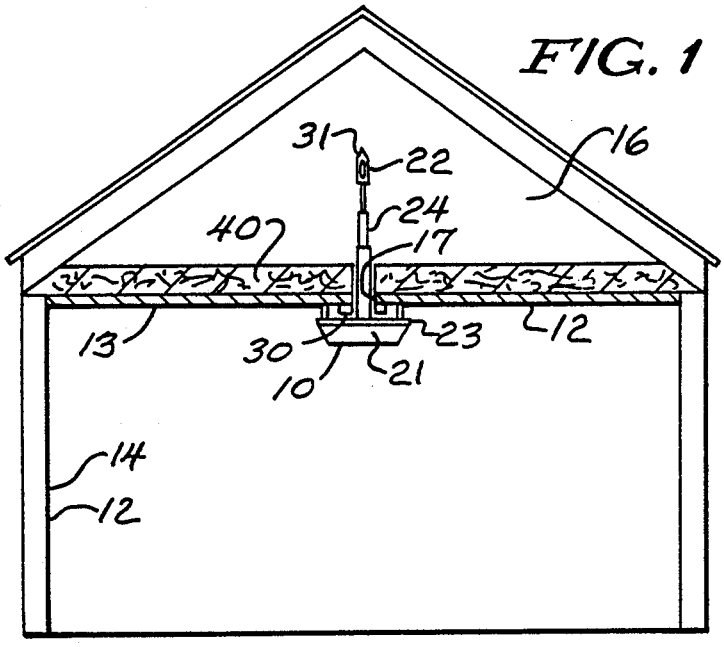
FIG. 2
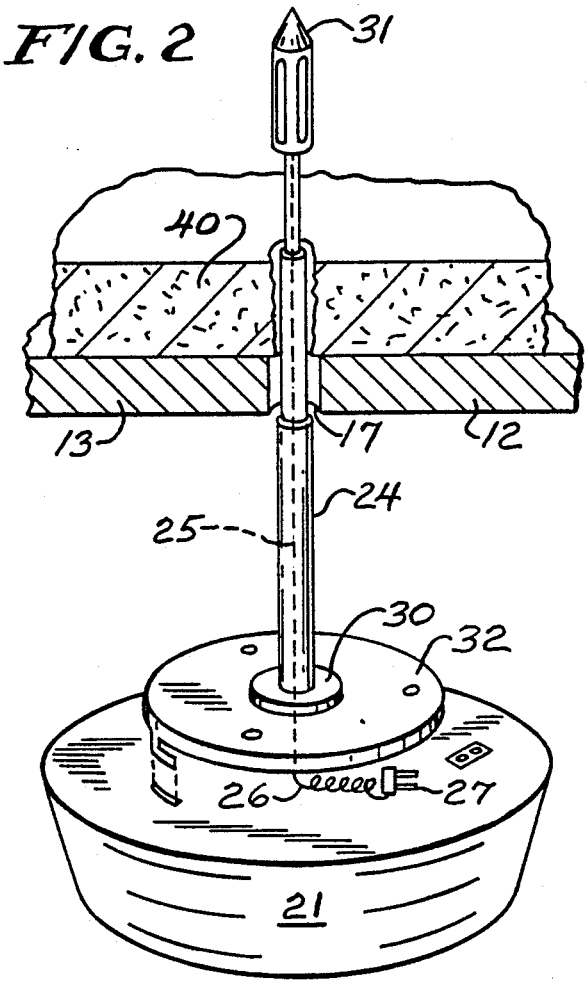
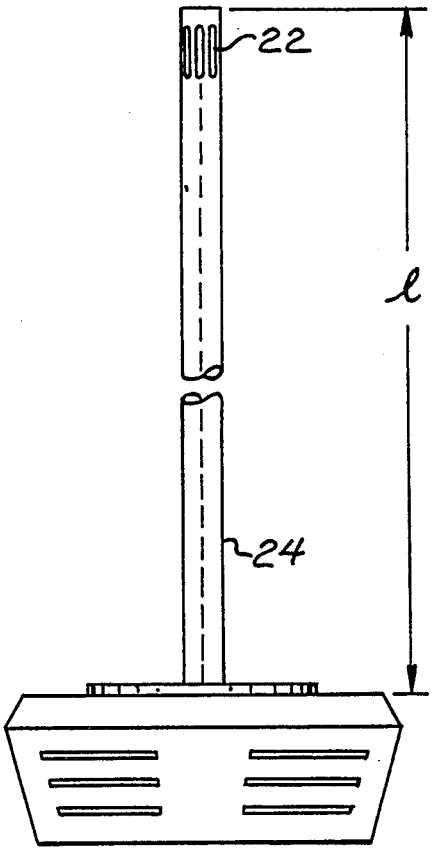
FIG. 3

FIG. 4
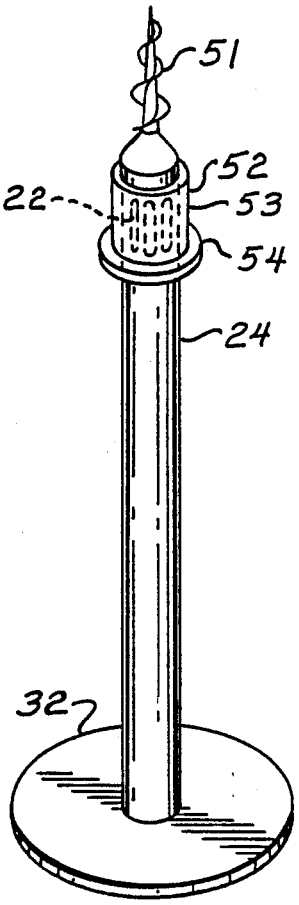
FIG. 5
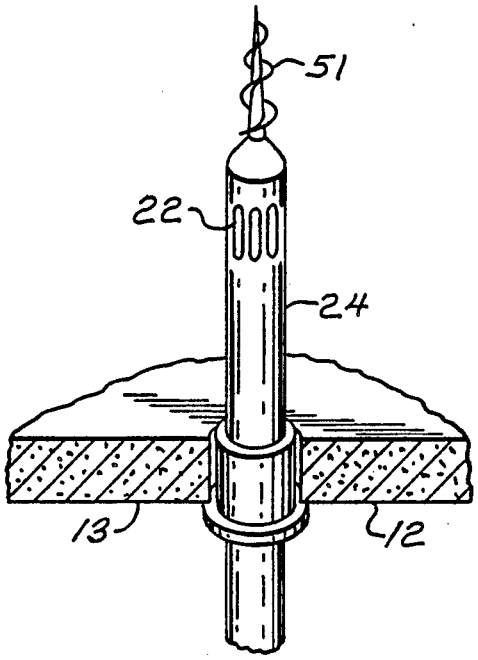
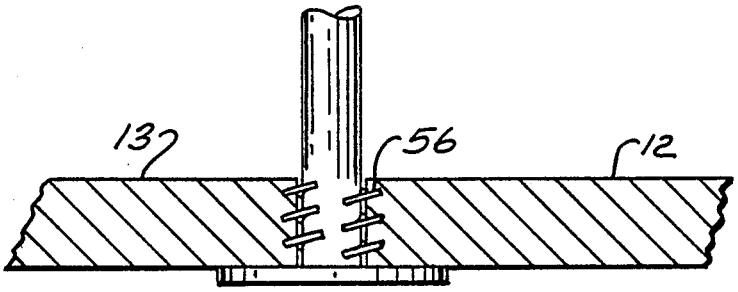
FIG. 6

SELF-PENETRATING REMOTE SENSING SMOKE DETECTOR

BACKGROUND OF THE INVENTION

1. Field of the Invention

The invention relates to a remote sensing smoke detector suitable for use in a building with hollow walls or ceilings such as with an attic or suspended ceiling or an attached closet, garage, or storage area. A main alarm and power source unit is affixed on the interior surface of the wall or ceiling, jointly referred to as planes with a mast extending therefrom through an opening or passageway in the plane. The mast provides for positioning of a sensor suitable for providing a signal to the main alarm unit in the presence of combustion products in the space above or behind the plane.

The signal is then appropriately amplified and converted to a desired alarm providing audio or visual indications, or both.

The mounting mechanism for the alarm unit includes a seal which may be a ring of elastomeric or other resilient material which seals the opening or passageway from communication with the interior room of the building and diluting the smoke, thereby improving a flexibility in mounting, reducing drafts and inaccuracies during sensing through passage of combustion gases from one side of the plane to the other.

The tip of the mast remote from the alarm unit may be fitted with a penetrating bit enhancing ease of placement of the entire apparatus by its penetration of obstructions above, or behind, the plane such as insulation in loose, batt or paper bonded roll form. With suitable removable protection for the smoke entry ports of a sensor, the bit and mast structure may be adapted to completely penetrate the plane without need for further tools, particularly in the case of suspended ceiling boards.

2. Description of Related Art

Several patents differing in structure and approach from the instant invention address certain aspects of the problem of sensing the presence of combustion products in remote spaces. Powers U.S. Pat. No. 4,758,827 issued July 19, 1988 addresses the problem of determining the presence of combustion products in a duct using an externally mounted smoke detector. Powers uses entrance and exit ports from the duct to the smoke detector and returning to the duct in order to accomplish the goal.

Two patents show variations on electronic remote sensing. Martin U.S. Pat. No. 4,160,246 issued July 3, 1979 uses radio transmission having one detector/transmitter unit and a receiver/annunciator. Machen U.S. Pat. No. 4,305,069 uses a self-contained removable remote or "personal" unit which may be removed from a "sustainer" unit for carrying by a person into a building space.

Rice U.S. Pat. No. 4,319,234 issued March 9, 1982 deals with a portable smoke detector adapted for fitting over a door and having two sensors one on either side of the door as will be seen; this does not address a number of the concerns dealt with applicant's structure including penetration of the remote space, penetration of obstructions and false alarms.

OBJECTS OF THE INVENTION

One object of the invention is to provide for ease of mounting a remote sensing smoke detector.

Another object of the invention is to provide support for a smoke detector sensor in a remote building space.

Another object of the invention is to enhance removability for testing, repair or replacement of a remote smoke detector sensor.

One advantage of the invention is to provide easy remote sensing of combustion products in a remote building space such as an attic or above a suspended ceiling, particularly in areas which may permit an unobstructed spread of fire through a building.

Another advantage of the invention is reduction in false alarms from such things as normal cooking combustion by isolating the sensor in a desired remote space.

Another advantage of the invention is to provide for a completely self-contained alarm unit, power source, support, conduit, mounting hardware and sensor thereby improving reliability, economy and ease of installation.

Another advantage of the invention is that the sensor mast can be adapted to provide for penetration of, at least, obstructions above or behind the surface on which the unit is mounted thereby avoiding a need for specialized installation tools.

BRIEF DESCRIPTION OF THE DRAWINGS

FIG. 1 is a sectional view of a building with the device in place.

FIG. 2 is a perspective sectional view of the device.

FIG. 3 is a plan view of an alternative embodiment.

FIG. 4 is a perspective view of an alternative embodiment.

FIG. 5 is a perspective sectional view of an alternative embodiment.

FIG. 6 is a sectional view of an alternative embodiment.

DESCRIPTION OF THE PREFERRED EMBODIMENTS

FIG. 1 is a sectional view showing a smoke detector 10 in place mounted on a plane or surface 12 in a building. A series of horizontal planes or surfaces 13 such as ceilings and vertical planes or surfaces 14 such as walls, define a building space 11 such as a room wherein the smoke detector 10 alarm or annunciator unit 21 is mounted. Remote from the building space 10 or room is a remote space 16 which may typically be an attic or the space above a suspended ceiling. The device may also be mounted to a wall, such as a garage attached to a residence. A sensor 22 is located in the remote space 16 by a hollow mast 24 extending normal to the mount 23 of the alarm unit 21.

FIG. 2 shows the smoke detector in relation to a ceiling 13 with insulation 40 above. The major elements are shown in exploded relation to one another.

Installation of the smoke detector is accomplished by drilling or otherwise boring a passageway 17 or opening in the desired plane 12 and extending the mast 24 therethrough. The passageway 17 is sealed on mounting of the alarm unit by a seal 30 which may be a resilient ring seal.

A penetrating bit 31 is placed in the preferred embodiment at distal end of the mast 24 or portion most remote from the alarm or annunciator unit 21. The penetrating bit is inserted into a pre-drilled passageway 17 and itself penetrates obstructions of loosely packed, low density and low strength nature such as insulation 40 placed above a ceiling 13.

It will be noted that prior art smoke detectors have a single sensor incorporated in the annunciator housing. It is feasible to include a dual sensor arrangement with an annunciator mounted, and a remote sensor 22. The dual sensors may be of the same, or complimentary types.

FIG. 3 illustrates another embodiment of my invention. In this embodiment the mast 24 is a continuous tube rather than a telescoping tube. The tube may be constructed to a diameter sufficient for enclosing the entire sensor 22. This embodiment is particularly adaptable to high volume and low cost production where, for example, multiple units with a predetermined mast length are standardized for use in multiple locations in a building with constant dimension suspended ceilings.

In this embodiment a telescoping mast 24 is used. The varying distance of mast extension requires arrangement for permitting the length of conductor 25 between the sensor 22 and alarm annunciator 21 to be varied or for slack to be taken up. Typically the mount 23 will be affixed to the surface 12 and the alarm or annunciator 21 will be removable therefrom for maintenance and the like. Thus slack in the conductor may be taken by a coil mechanism or the simple expedient of manually coiling 26. A connector or plug and socket arrangement enables separation of the conductor 25 from the annunciator or alarm 21 when demounted.

FIG. 4 shows an alternative embodiment for the penetrating bit utilizing a heavier auger 51 or other drill shape which may be utilized to drill the passageway 17 in the first instance. Appropriate strengthening of the mast 24 and protection of the sensor 22 (shown in Phantom) from shavings, particulates or other matter dislodged as a result of the drilling operation will protect the sensor 22 from contamination. Thus, a shield 52 includes a cylinder 53 and ceiling engagement collar 54. This embodiment may be particularly desirable where a bonded particulate ceiling panel is used such as in a suspended ceiling.

FIG. 5 shows the embodiment of FIG. 4 as it is installed through the aperture. The shield 52 exposes the sensor openings upon contact of the shield collar 54 with the surface or ceiling 13 and upward movement of the mast 24 therethrough.

In FIG. 6 another embodiment may incorporate blades 56 which may be arranged as screw threads to accomplish the mounting of the mounting plate 32 without additional fasteners by their engagement in the body of the bonded particulate panel or tile 12 and 13.

I claim:

1. A smoke detector for mounting to a building surface dividing a first building space from an inaccessible second building space, comprising;

an annunciator in the first building space operatively arranged to provide a warning of the presence of combustion products;

a sensor being extended from the annunciator through the surface and into the second building space and being adapted to activate said annunciator upon sensing combustion products;

a mast interconnecting the sensor and annunciator supporting the sensor at a selected position relative to the annunciator and facilitating the connection therebetween;

said sensor being electrically connected to said annunciator;

said mast being connected to and extending normally from a mount;

said mount being directly attached to said surface;

said mount being adapted for the connection and disconnection of the annunciator therefrom for installation and servicing;

said mast further comprising a telescoping tube;

said sensor and annunciator being electrically connected by a conductor passing through said mast;

said conductor being coilable so as to permit conformation with varying lengths of extension of said tube;

said conductor further being connectable and disconnectable from said annunciator; and said mast having a bit at the end distal the annunciator for penetrating obstructions adjacent said surface.

2. A smoke detector for mounting to a building surface dividing a first building space from an inaccessbile second building space, comprising;

an annunciator in the first building space operatively arranged to provide a warning of the presence of combustion products;

a sensor being extended from the annunciator through the surface and into the second building space and being adapted to activate said annunciator upon sensing combustion products;

a mast interconnecting the sensor and annunciator supporting the sensor at a selected position relative to the annunciator and facilitating the connection therebetween;

said sensor being electrically connected to said annunciator;

said mast being connected to and extending normally from a mount;

said mount being directly attached to said surface;

said mount being adapted for the connection and disconnection of the annunciator therefrom for installation and servicing;

said mast further comprising a tube of fixed length;

said sensor and annunciator being electrically connected by conductor passing through said mast;

said conductor being coilable so as to permit conformation with varying lengths of extension of said tube;

said conductor further being connectable and disconnectable from said annunciator; and said mast having a bit at the end distal the annunciator for penetrating said surface.

3. The invention according to claim 2 and a movable shield slidably mounted on said mast for protecting said sensor during penetrating and mounting on said surface.

4. The invention according to claim 2 and said mount further comprising spiral blades for threadily mounting said mount to said surface.

* * * * *